United States Patent [19]

Dismuke

[11] 4,094,290

[45] June 13, 1978

[54] FUEL ATOMIZER

[75] Inventor: William Odell Dismuke, Memphis, Tenn.

[73] Assignees: Courtney C. Pace, Washington, D.C.; Ulle C. Linton, Rockville, Md.; Casey C. Pace, Jackson, Miss. ; part interest to each

[21] Appl. No.: 477,106

[22] Filed: Jun. 6, 1974

[51] Int. Cl.[2] ..... F02M 29/00

[52] U.S. Cl. ..... 123/141; 48/180 R

[58] Field of Search ..... 123/141; 137/479; 48/180 R, 180 B

[56] References Cited

U.S. PATENT DOCUMENTS

| | | | |
|---|---|---|---|
| 1,074,136 | 9/1913 | Parker | 48/180 R |
| 1,142,674 | 6/1915 | Crouch | 48/180 R |
| 1,513,196 | 10/1924 | Stratman | 48/180 R |
| 1,743,622 | 1/1930 | Rogacewicz et al. | 48/180 R |
| 1,806,356 | 5/1931 | Lynn et al. | 48/180 R |
| 2,120,866 | 6/1938 | Paul | 137/479 |
| 2,136,719 | 11/1938 | Weinberg | 123/141 |
| 2,216,477 | 10/1940 | O'Sullivan | 48/180 R X |
| 2,792,290 | 5/1957 | Malouf | 48/180 R |
| 2,792,291 | 5/1957 | Malouf | 48/180 R |
| 3,682,608 | 8/1972 | Hicks | 48/180 R |

FOREIGN PATENT DOCUMENTS

| | | | |
|---|---|---|---|
| 594,334 | 3/1934 | Germany | 123/141 |

*Primary Examiner*—Charles J. Myhre
*Assistant Examiner*—Ira S. Lazarus
*Attorney, Agent, or Firm*—Ulle C. Linton

[57] ABSTRACT

A device mountable between the carburetor and intake manifold of an internal combustion engine through which the air-fuel mixture from the carburetor passes and including superposed wire screens with balls therebetween which creates a whirling mass of a highly volatile vapor of said mixture entering the manifold to cause a maximum combustion of said mixture in the engine cylinders.

1 Claim, 4 Drawing Figures

A
B
1
2
3
3a
4
5
6
7
8
9
9c
10
11
12
13
15
16
17
18
19
19a
20
21
21a
22
23
24
25
26
27
28
29
30
31
32
33
34
35
36
37
38
39

FUEL ATOMIZER

BACKGROUND OF THE INVENTION

The present invention is an improvement in devices for mixing the air fuel mixture for engines.

Carburetors of internal combustion engines take in a fuel, such as gasoline, and air, mixes the same in the proper amount and said mixture is drawn into the intake manifold and cylinders of the engine during the operation thereof. However, the resulting combustion of said mixtures in known engines does not completely explode the mixture resulting in unburnt gasoline and undesirable exhaust gases leaving the engine. Various devices have been tried to increase the combustion of the fuel mixture including various screen arrangements at the entrance to the intake manifold of the engine.

PRIOR ART

The following United States Patents disclose devices related to the present device.

580,700
1,394,820
1,422,961
3,449,098
3,459,162
3,482,556
2,120,866
2,136,719
2,792,291
3,322,407
2,645,243
3,648,674
3,648,676

BRIEF SUMMARY OF THE INVENTION

The principle object of the present invention is to provide a device that will form an air-fuel mixture into a highly volatile vapor in a much improved form over those in the known prior art.

To obtain this object a device having two thin superimposed metal plates of a shape conforming to the outlet base of a carburetor and the inlet top of an intake manifold is provided with a pair of screens extending between and retained in position between said plates which screens have a concavo-convex configuration in their central portions with a plurality of metal balls loosely positioned between said screens central portions whereby an air fuel mixture passing through said screen central portions and over said balls is churned into a whirling mass before entering the engine intake manifold.

DESCRIPTION OF THE PREFERRED EMBODIMENTS

Figures 1, 2, 3, 4:
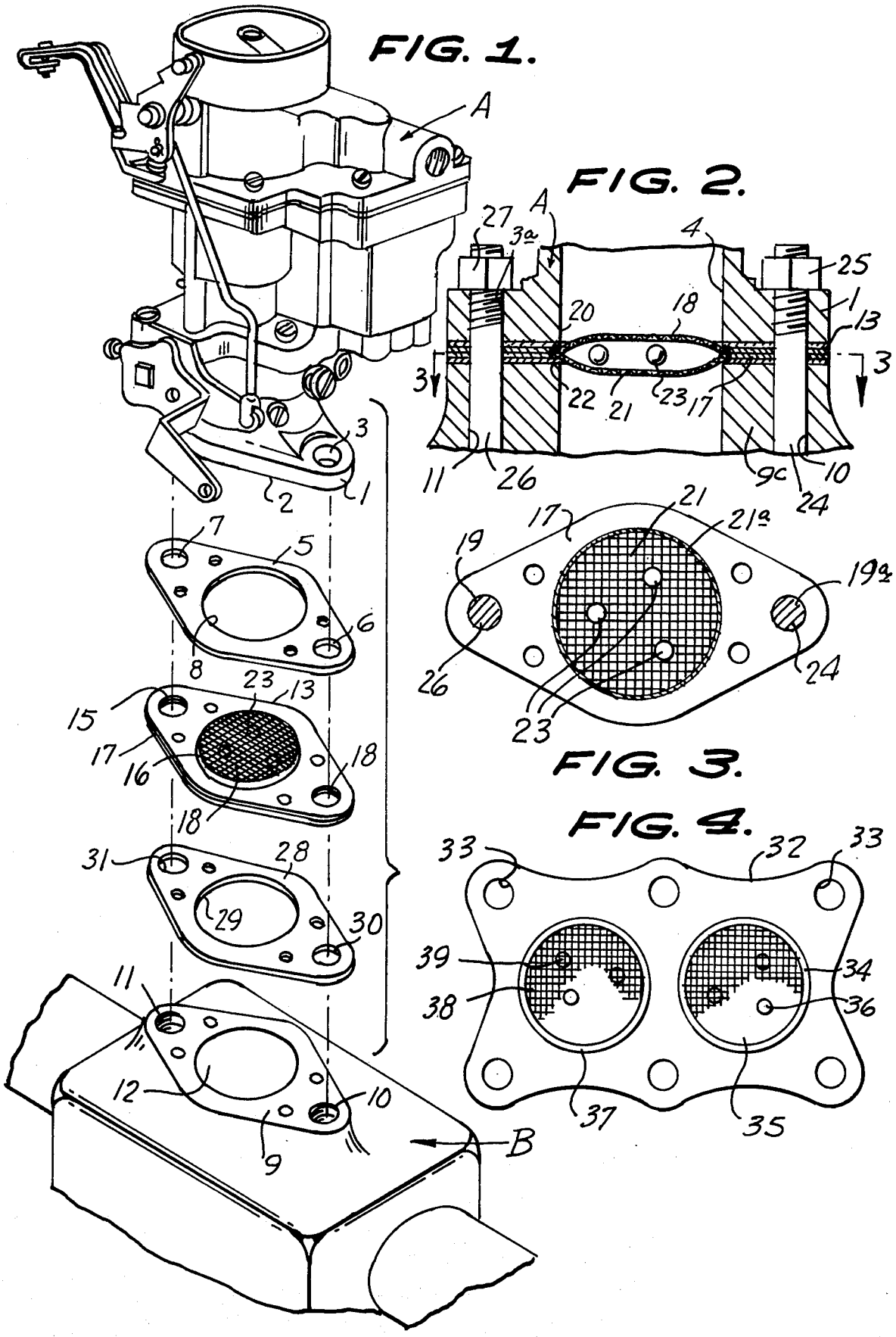
FIG. 1 is an exploded perspective view of a carburetor and intake manifold showing the position of the present device therebetween.
FIG. 2 is an enlarged cross-sectional view of the present device as mounted in use.
FIG. 3 is a cross-sectional view taken on line 3—3 of FIG. 2.
FIG. 4 is a view similar to FIG. 3, but of a modified form of the device.

Referring now more particularly to the accompanying drawing on which like and corresponding parts are designated by similar reference characters, A generally indicates a conventional carburetor of an internal combustion engine and B the intake manifold of the engine. Said carburetors generally have a base 1 with a flat bottom 2, bolt holes 3, and a fuel passage 4 opening in said bottom.

A gasket 5 shaped to match bottom 2 has bolt holes 6 and 7 and fuel opening 8.

Intake manifold B has top 9 shaped to match gasket 5 and said gasket is positioned between bottom 2 and top 9. Said top 9 has threaded bolt holes 10 and 11 and fuel passage 12 in alignment with fuel passage 4 and gasket opening 8. Bolt holes 3, 6 and 10 are aligned as are bolt holes **3*a*, 7 and 11**.

The above elements are conventional in internal combustion engines.

The present device has a pair of thin metal plates 13 and 17 superimposed on one another and of a configuration matching bottom 2, gasket 5 and top 9 as shown in FIG. 3. Plate 13 has bolt holes 14 and 15 and a raised annular central rim 16.

Plate 17 is similar to plate 13 and has bolt holes 19 and **19*a* in line with bolt holes 6 and 7 respectively and a raised annular central rim 22 coinciding with rim 16**, but extending in an opposite direction providing a space between said rims.

Annular screen 18 has a marginal portion 20 extending beneath rim 16 and seated on the marginal portion **21*a* of annular screen 21. Marginal portion 21*a* is seated beneath rim 22. Screens 18 and 21** each have a central concavo-convex portion with said portions extending in opposite directions.

A plurality of metal balls 23, for example of steel or brass, are caged between screens 18 and 21 and loosely positioned therebetween and free to move around therein.

A second gasket 28 similar to gasket 5, has bolt holes 30 and 31 and fuel opening 29. Gasket 28 is positioned between plate 17 and top 9 with holes 30 and 31 aligned with holes 10 and 14 and 11 and 15, respectively.

Bolt 24 is threaded into bolt hole 10, extends through holes 30, 19, 14, 6 and 3 and nut 25 thereon tightens base 1 towards top 9. Similarly bolt 26 is threaded in bolt hole 11 and extends through openings 31, **19*a*, 15, 7 and 3*a* while nut 27 thereon tightens base 1 towards top 9**.

In FIG. 4 there is shown a modified form of the present device for use with a conventional two barrell carburetor and matching intake manifold. Two similar thin metal plates such as plate 32 have bolt holes 33, annular raised rims 34 and 37 with concavo-convex screens such as 35 and 38 and balls 36 and 39 therebetween and are arranged and mounted in the same manner as the elements of the device 13 - 23. Screens 34 and balls 36 are in line with one carburetor barrel and screens 38 and balls 39 in line with the other carburetor barrel.

It is to be appreciated that the devices 13–23 and 32–39 can be readily modified for use with four barrel carburetors as well following the above teachings.

Screens 18, 21, 35 or 38 can have a diameter of one and a half inches and screens 18 and 21 or 35 or 38 raised from one another providing a half inch space therebetween at their apex with balls 23 or 36 or 39 each having a one-eighth inch diameter.

In the use of the device of FIGS. 1–3 or 4, air fuel mixture is drawn from passage 4 of the carburetor through opening 8, screens 18 and 21 or screens 35 and 38 through opening 29 and into opening 12 of the intake manifold B of the engine. The fuel air mixture passing said screens and balls is churned into a whirling mass of a highly volatile vapor and when it enters each engine cylinder and is ignited the entire mixture will explode with maximum effectiveness leaving a minimum of waste fuel resulting is greater engine power and low exhaust emissions.

I claim:

1. A fuel atomizer to be mounted between an internal combustion engine carburetor and intake manifold comprising superimposed metal plates having at least one common central opening, a pair of superposed screens fixedly connected to said plates and extending across said central opening and said screens having portion spaced apart at said central opening and a plurality of balls freely positioned between said spaced apart portions of said screens in the space therebetween, wherein said plates have oppositely raised rims around said opening and said screens have marginal edges extending in between said rims.

* * * * *